US006742814B2

(12) United States Patent
Resmo et al.

(10) Patent No.: US 6,742,814 B2
(45) **Date of Patent: *Jun. 1, 2004**

(54) MINIATURE PATIO HEATER

(75) Inventors: Michael Resmo, Castle Rock, CO (US); Sung Boo Yoon, Bu San (KR)

(73) Assignee: CFM-RMC International, a division of the Vermont Castings Majestic Products Company, Huntington, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/093,588

(22) Filed: Mar. 7, 2002

(65) Prior Publication Data

US 2002/0089178 A1 Jul. 11, 2002

Related U.S. Application Data

(62) Division of application No. 09/662,976, filed on Sep. 15, 2000, now Pat. No. 6,446,623.

(51) Int. Cl.[7] ..... F16L 27/00; F24C 5/20; F23D 14/28

(52) U.S. Cl. ..... 285/272; 285/275; 285/281; 126/92 B; 126/38; 126/92 R; 431/344; 137/615

(58) Field of Search ..... 285/179, 190, 285/272, 275, 280, 281; 126/92 B, 92 R, 38; 431/344; 137/615

(56) References Cited

U.S. PATENT DOCUMENTS

| | | | | |
|---|---|---|---|---|
| 1,042,750 A | * | 10/1912 | Bader | 431/344 |
| 2,570,406 A | * | 10/1951 | Troshkin et al. | 285/281 |
| 2,574,625 A | * | 11/1951 | Coss | 29/443 |
| 2,861,562 A | | 11/1958 | Ross et al. | |
| 3,080,861 A | | 3/1963 | Amero | |

(List continued on next page.)

FOREIGN PATENT DOCUMENTS

| | | | |
|---|---|---|---|
| EP | 976 979 A1 | | 2/2000 |
| FR | 2764677 | | 12/1998 |
| IT | 526841 | | 5/1955 |
| JP | 7-286736 | * | 10/1995 |
| JP | 9-196381 | * | 7/1997 |
| JP | 9-196381 A | | 9/1997 |

OTHER PUBLICATIONS

Claims 16–20 of copending U.S. application 10/371,316.*
Claims 16–28 of copending U.S. application 10/093,594.*
Solutions Brochure, "Outdoor Heater", Mar. 1999 p. 55 (2 pgs.).

(List continued on next page.)

*Primary Examiner*—James M. Hewitt
(74) *Attorney, Agent, or Firm*—Sheridan Ross P.C.

(57) ABSTRACT

A miniature patio heater is provided which has a total height of approximately 3 ft. and which has a shroud with a diameter less than 2 ft. The patio heater includes a base having a vertically extending chamber, which is approximately 1.5 ft. high, for receiving a small gas bottle. A hollow post extends upwardly from the upper end of the chamber. A heater assembly and shroud are supported at the upper end of the post. A gas line extends along the inside of the hollow post between the heater assembly and the chamber. A connector assembly provides a pivotal connection between the end of the gas line and a regulator connected to a gas bottle within the chamber. The chamber is provided with an access opening for inserting and removing the gas bottle. Thus, the gas bottle, with attached regulator, can be swung from a vertical upright position within the chamber outwardly through the access opening to an angular position to facilitate removal of an empty gas bottle and replacement with a fall gas bottle. The full gas bottle can then be swung from the angular position to a vertical upright position within the chamber. A removable cover can be provided over the access opening.

4 Claims, 3 Drawing Sheets

U.S. PATENT DOCUMENTS

| | | | | | |
|---|---|---|---|---|---|
| 3,590,806 | A | | 7/1971 | Locke | |
| 3,763,847 | A | | 10/1973 | Guzdar et al. | |
| 3,813,207 | A | | 5/1974 | Ramey | |
| 4,063,876 | A | * | 12/1977 | Schweiss | 432/222 |
| 4,113,288 | A | * | 9/1978 | Cox | 285/148.15 |
| 4,378,783 | A | | 4/1983 | Hunter | |
| D319,305 | S | | 8/1991 | Beavers et al. | |
| 5,052,432 | A | * | 10/1991 | Vonalt et al. | 137/355.16 |
| 5,063,968 | A | * | 11/1991 | Bartholomew | 138/109 |
| D325,963 | S | | 5/1992 | Anderson | D23/342 |
| 5,553,601 | A | | 9/1996 | Parker et al. | |
| 5,553,893 | A | * | 9/1996 | Foti | 285/147.1 |
| 5,738,084 | A | | 4/1998 | Hussong | |
| 5,890,887 | A | * | 4/1999 | Adler | 431/344 |
| 5,964,233 | A | | 10/1999 | Clark et al. | 135/16 |
| 5,979,432 | A | | 11/1999 | Grove | |
| 6,065,468 | A | | 5/2000 | Willey et al. | |
| 6,102,031 | A | * | 8/2000 | Waters | 126/92 AC |
| 6,213,761 | B1 | | 4/2001 | Schmidt | |
| 6,340,298 | B1 | | 1/2002 | Vandrak et al. | |
| 6,397,835 | B1 | | 6/2002 | Liang | |
| 6,446,623 | B1 | * | 9/2002 | Resmo et al. | 126/92 R |
| 6,447,017 | B1 | * | 9/2002 | Gilbreath et al. | 285/89 |
| 6,619,281 | B2 | * | 9/2003 | Resmo et al. | 126/92 B |

OTHER PUBLICATIONS http://raytech.simplenet.com/heaterssunglo.htm, "SUNGLO style heater", Dec. 20, 1999, Raytech, 3 pp.

http://www.easyradiantworks.com/sub/patio.eht, "Patio Plus Outdoor Heater", Easy Radiant Works, 12/20/99m 2 pp.

Improvements Catalog, "Firepole Space Heater", Mar. 3, 2000, 1 pg.

* cited by examiner

MINIATURE PATIO HEATER

This is a Divisional application of pending prior application Ser. No. 09/662,976, filed Sep. 15, 2000, now U.S. Pat. No. 6,446,623. The entire disclosure of this prior application is considered to be part of the disclosure of the accompanying application and is hereby incorporated by reference.

TECHNICAL FIELD

This invention relates to an outdoor space heater and, more particularly, to a miniature patio heater for home use.

BACKGROUND ART

Large patio heaters for commercial use, such as outdoor patios at restaurants and outdoor recreational facilities, have been in use for many years. These patio heaters extend the hours of the day and the season during which outdoor activities may be comfortably enjoyed. Such outdoor patio heaters are typically quite large, being 8 to 10 ft. in height so that they spread heat over a large 15 ft. diameter area. In some applications, the heater and shroud are supported by a roof structure. However, it is more common for the heater and shroud to be supported on a post. In some instances, the post is mounted in the patio surface and gas is supplied from a central supply through gas tubing extending under the patio surface and up through the post to the heater. In other instances, the lower end of the posts is mounted in a large base. Gas is supplied to the heater from a gas bottle mounted in the base. Such patio heaters require a large gas bottle. Therefore, the base must be of substantial size in order to accommodate the large gas bottle. Furthermore, the base must be of substantial size and weight in order to support the large patio heater safely so that it does not topple over due to winds or people leaning against it.

Examples of such patio heaters are shown in U.S. Pat. No. Des. 325,963 to Anderson and U.S. Pat. No. 5,964,233 to Clark, et al. Although these patio heaters are suitable for their intended purpose, they are not practical for home use on a patio wherein space is often limited and the size and weight of a large patio heater is prohibitive in that it cannot be easily moved around by persons in the household.

DISCLOSURE OF THE INVENTION

A miniature patio heater is provided which has a total height of approximately 3 ft. and which has a shroud with a diameter less than 2 ft. The patio heater includes a base having a vertically extending chamber, which is approximately 1.5 ft. high, for receiving a small gas bottle. A hollow post extends upwardly from the upper end of the chamber. A heater assembly and shroud are supported at the upper end of the post. A gas line extends along the inside of the hollow post between the heater assembly and the chamber. A connector assembly provides a pivotal connection between the end of the gas line and a regulator connected to a gas bottle within the chamber. The chamber is provided with an access opening for inserting and removing the gas bottle. Thus, the gas bottle, with attached regulator, can be swung from a vertical upright position within the chamber outwardly through the access opening to an angular position to facilitate removal of an empty gas bottle and replacement with a fall gas bottle. The fall gas bottle can then be swung from the angular position to a vertical upright position within the chamber. A removable cover can be provided over the access opening.

This arrangement allows one to change bottles without getting down on their hands and knees. Also, the height requirement for the chamber is minimized because extra vertical space for attaching and detaching the gas bottle is not required. Additional advantages of this invention will become readily apparent from the description which follows, taken in conjunction with the accompanying drawings.

BEST MODE FOR CARRYING OUT THE INVENTION

Figure 1:
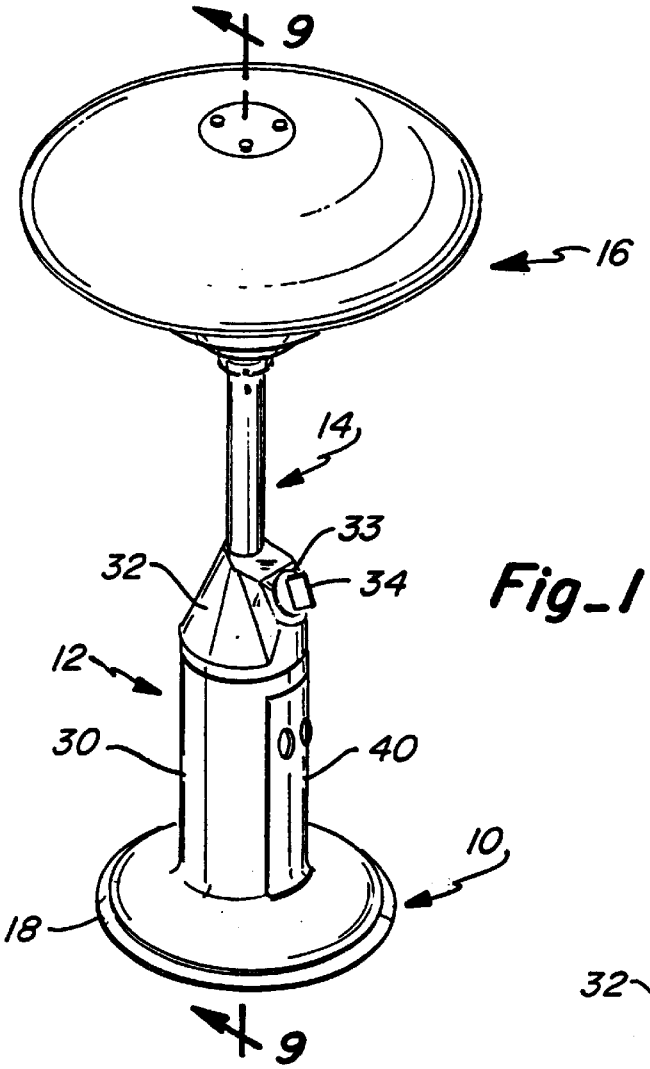
FIG. 1 is a perspective view of the miniature patio heater of this invention.
Figure 9:
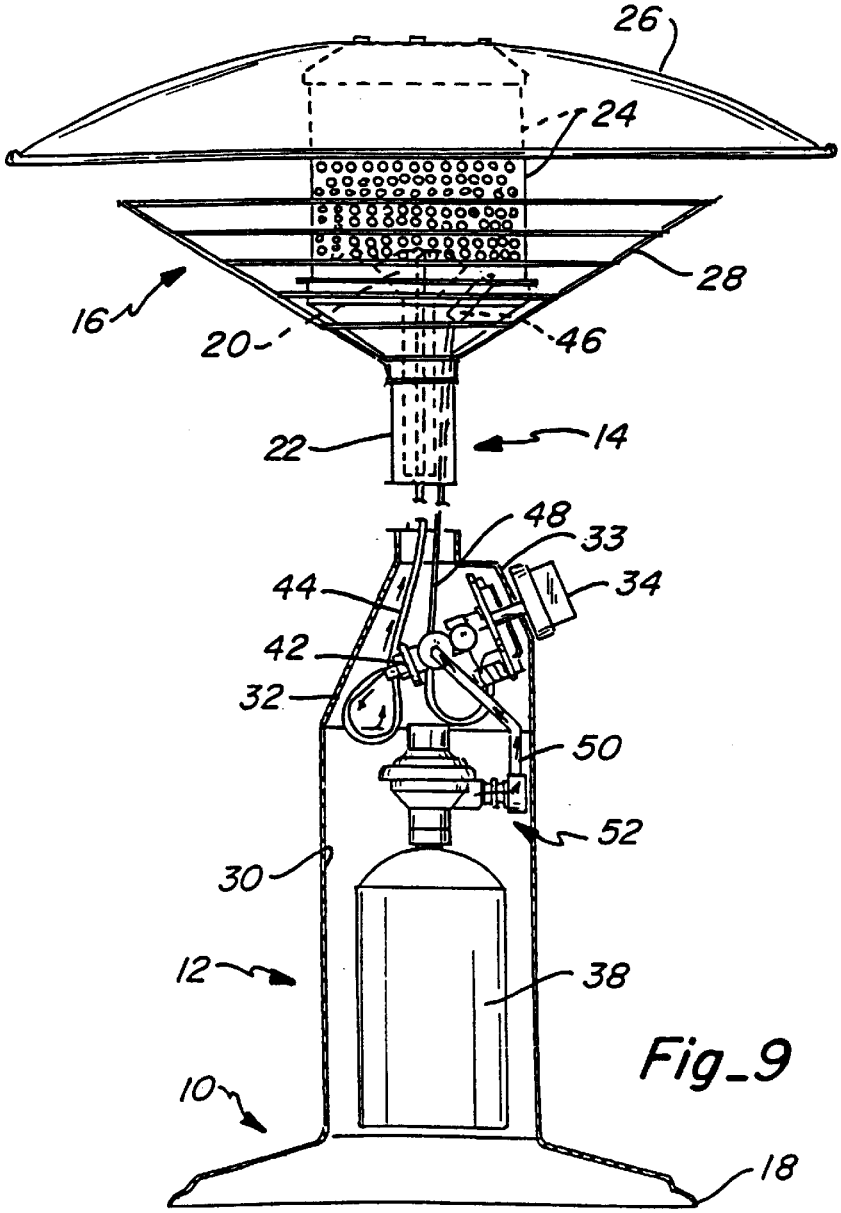
FIG. 9 is a fragmentary, vertical sectional view of the miniature patio heater.

As best seen in FIGS. 1 and 9, the miniature patio heater of this invention includes a base 10, a gas bottle chamber 12 extending upwardly from the center of base 10, a hollow post 14 which has a lower end connected to the upper end of chamber 12 and an upper end which supports heater assembly 16. Base 10 has a circular peripheral edge 18 which is of sufficient diameter to minimize the possibility of the patio heater tipping over. Although base 10 is shown as being circular, it will be understood that it could be of any other suitable configuration, such as square, octagonal, etc. As best seen in FIG. 9, heater assembly 16 includes a conventional burner assembly 20 mounted on a sleeve 22 at the upper end of post 14. A combustion chamber 24 is positioned above burner assembly 20 and supports a shroud 26 which reflects radiant heat toward the ground. A safety guard 28 extends around burner assembly 20 and the lower portion of combustion chamber 24.

Figure 2:
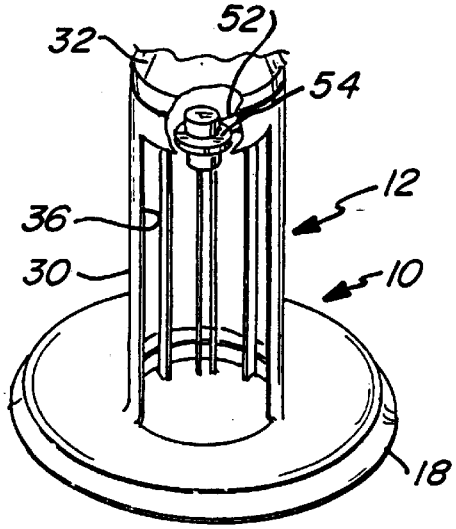
FIG. 2 is a fragmentary perspective view of the lower portion of the miniature patio heater showing the connector assembly with attached regulator in a vertical position within the gas bottle chamber.
Figure 3:
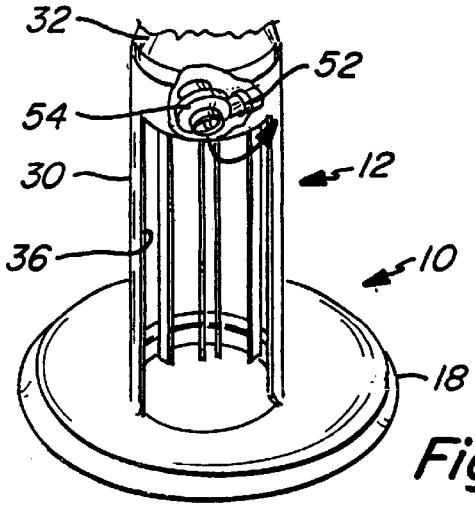
FIG. 3 is a fragmentary perspective view, similar to FIG. 2, but showing the regulator rotated to an angular position.
Figure 4:
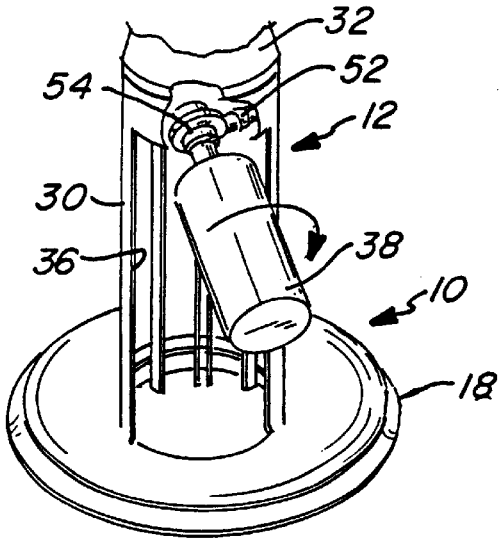
FIG. 4 is a fragmentary perspective view, similar to FIG. 3, but showing a gas bottle being attached to the regulator in an angular position.

Chamber 12 has a generally cylindrical side wall 30 and a tapered upper end 32, as shown, which includes a control panel 33 on which a control knob 34 is mounted. An access opening 36 is formed in side wall 30 for inserting and removing a gas bottle 38, shown in FIGS. 4 and 5, and described more fully below. Access opening 36 may be closed by a removable access cover 40, seen in FIG. 1. Referring to FIG. 9, control knob 34 operates a valve assembly 42 for controlling the flow of gas from gas bottle 38 to gas line 44. Knob 34 or some other device can be provided to selectively activate a spark ignition device 46 through wire 48. A gas conduit 50 extends from valve 42 to a connector assembly 52 which facilitates the rotation of regulator 54 between the vertical position shown in FIG. 2 to the angular position shown in FIG. 3 and back again.

Figure 6:
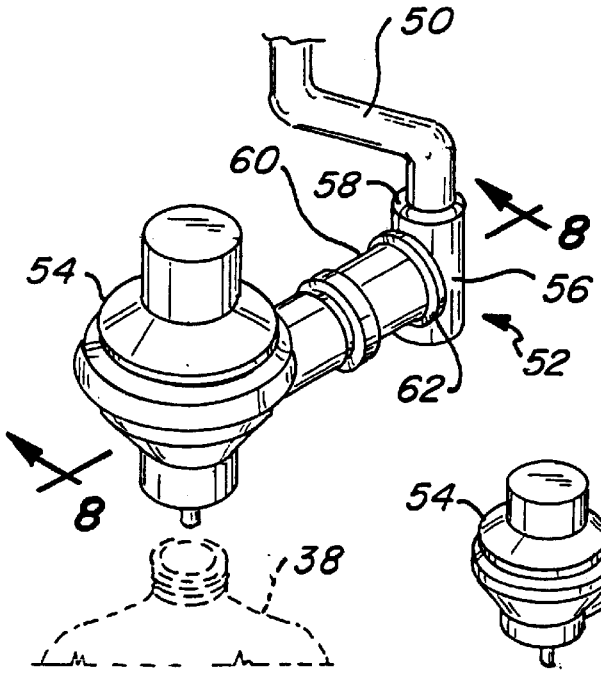
FIG. 6 is an enlarged perspective view of the regulator and connector assembly.
Figure 7:
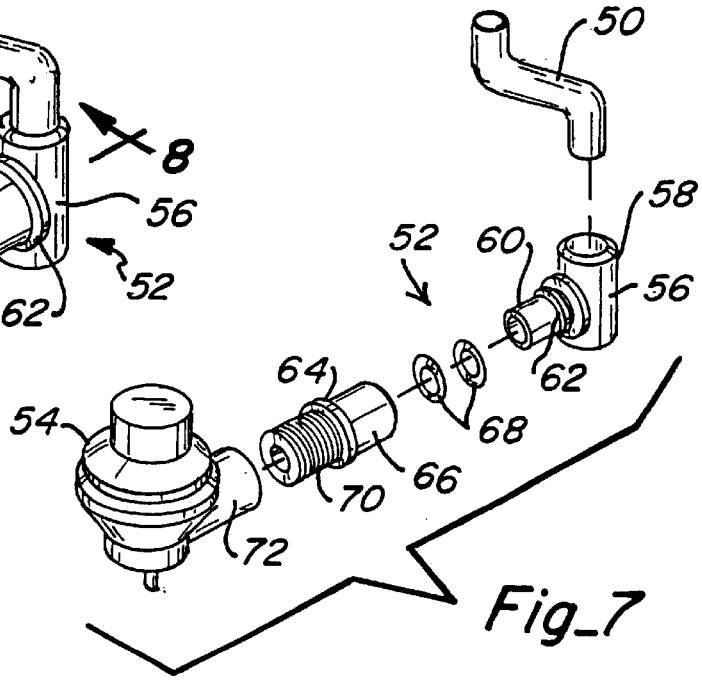
FIG. 7 is an exploded view of the connector assembly.
Figure 8:
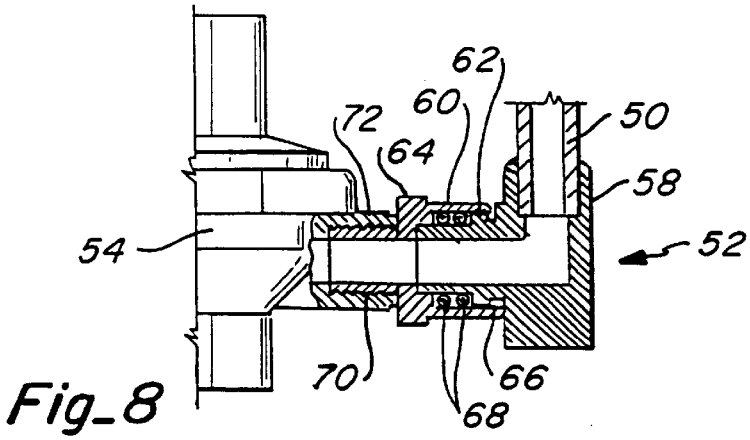
FIG. 8 is a vertical section, taken along line 8—8 of FIG. 6.

Referring to FIGS. 6 and 7, connector assembly 52 includes a first coupling half in the form of elbow 56 having a collar 58 for receiving the lower end of gas conduit 50. A suitable adhesive can be used between the end of gas conduit 50 and collar 58 to provide a gas-proof seal. Elbow 56 has a tubular male coupling 60 extending at right angles to collar 58 and includes a shoulder 62, as shown. A second coupling half in the form of union 64 has a tubular sleeve 66 which is received over male coupling 60 and snaps over shoulder 62. A pair of seals 68 are positioned between shoulder 62 and the inner end of sleeve 66. This structure permits union 64 to rotate with respect to elbow 56. The opposite end 70 of union 64 is threaded for attachment to outlet 72 of regulator 54. The ability of union 64 to rotate relative to elbow 56 in connector assembly 52 is highly advantageous in changing gas bottles.

Figure 5:
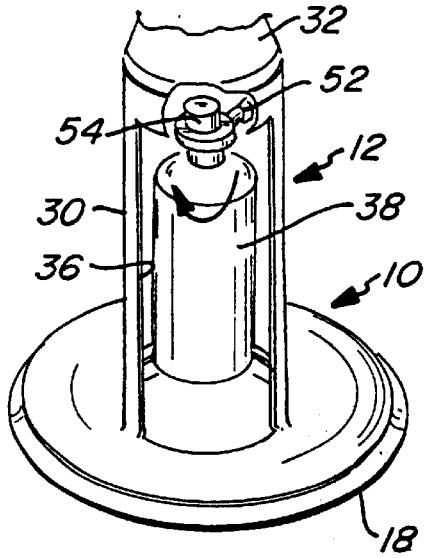
FIG. 5 is a fragmentary perspective view, similar to FIG. 2, but showing a gas bottle attached to the regulator and in an upright vertical position.

To replace an empty gas bottle, access cover 40 is removed from chamber 12 for access to an empty gas bottle 38 through access opening 36. The gas bottle 38 is grasped and rotated, with regulator 54, from a vertical upright position to the angular position shown in FIG. 4 because of the relative rotation between union 64 and elbow 56. The empty gas bottle 38 is removed from regulator 54 and replaced with a full gas bottle 38. Then the full gas bottle 38, with regulator 54, is rotated from the angular position back to a vertical upright position as shown in FIG. 5. Finally, access cover 40 is replaced to close access opening 36.

There are several advantages to this arrangement. In the first place, chamber 12 can be shorter than would otherwise be possible to replace gas bottle 38 since no extra vertical height is required for detaching and attaching gas bottle 38 to regulator 54. Furthermore, this arrangement is easier for the person changing the gas bottles. If the gas bottles had to be changed while in the vertical position, the person would have to get down on their hands and knees to do so. With the arrangement of this invention, the person need only to bend over and grasp the gas bottle and rotate it, along with regulator 54, from the vertical upright position to the angular position. After changing bottles, the fill gas bottle can be swung from the angular position to the vertical upright position without getting down on hands and knees.

This invention has been described in detail with reference to particular embodiments thereof, but it will be understood that various other modifications can be effected within the spirit and scope of this invention.

What is claimed is:

1. A connector for a heater and compounds of the heater comprising:

a gas bottle;

a gas line;

a regulator mounted to said gas bottle;

a first coupling half having a first end connected to the gas line and having a second end including a smooth surface;

a second coupling half having a first end in fluid communication with the regulator and a second end including a smooth surface connected to said second end of said first coupling half for selective rotational movement of said second coupling half about said second end of said first coupling half;

at least one seal positioned between said second end of said first coupling half and said second end of said second coupling half; and said first end of said second coupling half includes threads connected to said regulator, wherein the selective rotational movement results in continued sealing engagement between said first and second coupling halves, and wherein rotation of said bottle allows for and results in the selective rotational movement.

2. The connector for a heater and components of the heater, as claimed in claim 1, wherein:

said at least one seal includes a plurality of seals spaced along the connection between said second end of said first coupling half and said second end of said second coupling half.

3. A connector for a heater and components of the heater, comprising:

a chamber having a side wall a gas line;

a first coupling half having a first end, and a second end having a smooth surface, said first end connected to said gas line;

a regulator;

a second coupling half having a first ends and a second end including a smooth surface, said first end of said second coupling half connected to said regulator, and said second end of said second coupling half connected to said second end of said first coupling half for selective rotational movement of said second coupling half about said second end of said first coupling half;

at least one seal between said second end of said first coupling half and said second end of said second coupling half; and a gas bottle connected to said regulator and housed in said chamber wherein said gas bottle is rotatable from a first use position to a second angular position so that the gas bottle extends away from the chamber.

4. The connector for a heater and components of the heater, as claimed in claim 3, wherein:

said second ends of said first and second coupling halves each are tubular shaped members placed in a concentric overlapping arrangement.

* * * * *

UNITED STATES PATENT AND TRADEMARK OFFICE

CERTIFICATE OF CORRECTION

PATENT NO. : 6,742,814 B2
DATED : June 1, 2004
INVENTOR(S) : Resmo et al.

It is certified that error appears in the above-identified patent and that said Letters Patent is hereby corrected as shown below:

Column 3,
Line 45, please delete “compounds” and replace with -- components --.
Line 45, after “heater” please insert -- , --.

Column 4,
Line 30, please delete “ends” and replace with -- end, --.

Signed and Sealed this

Third Day of August, 2004

JON W. DUDAS
*Acting Director of the United States Patent and Trademark Office*